United States Patent [19]

Butterfield

[11] 4,197,594

[45] Apr. 15, 1980

[54] HYGIENE APPARATUS FOR TOILETS

[76] Inventor: Peter Butterfield, 1311-2nd W., Seattle, Wash. 98119

[21] Appl. No.: 927,725

[22] Filed: Jul. 24, 1978

[51] Int. Cl.[2] ..... A47K 3/22

[52] U.S. Cl. ..... 4/7

[58] Field of Search ..... 4/6, 7; 128/227, 229

[56] References Cited

U.S. PATENT DOCUMENTS

| | | | |
|---|---|---|---|
| 1,346,252 | 7/1920 | Rathbone | 4/7 |
| 1,521,892 | 1/1925 | Koppin | 4/7 |
| 3,605,124 | 9/1971 | Marcard et al. | 4/7 |
| 3,925,826 | 12/1975 | Huyot | 4/7 |
| 4,041,553 | 8/1977 | Sussman | 4/7 |
| 4,068,325 | 1/1978 | Benthin | 4/7 |

*Primary Examiner*—Stuart S. Levy

*Attorney, Agent, or Firm*—Cole, Jensen & Puntigam

[57] ABSTRACT

The apparatus is adapted to fit on the lower surface of conventional toilet seats, and comprises (1) a base element, (2) a support element, including handle, rotatably secured to the base element, (3) an elongated fluid carrying arm extending from the support, and (4) a sprayhead. By rotating the handle, the sprayhead moves through a relatively shallow arc from a retracted position adjacent the lower surface of the seat at the rear thereof through an operative path beneath the opening in the seat. The axis of rotation of the support element and the configuration of the fluid-carrying arm are such that the focal point of the arc of the sprayhead is several inches above the plane of the seat.

7 Claims, 8 Drawing Figures

Fig. 1
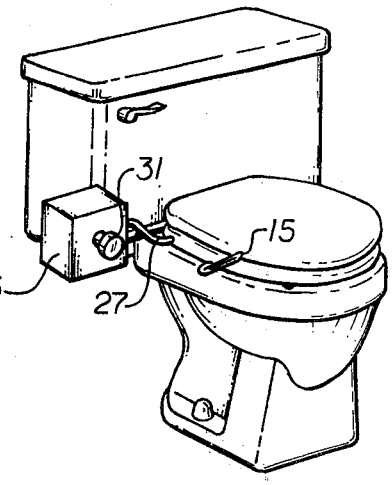
Fig. 2
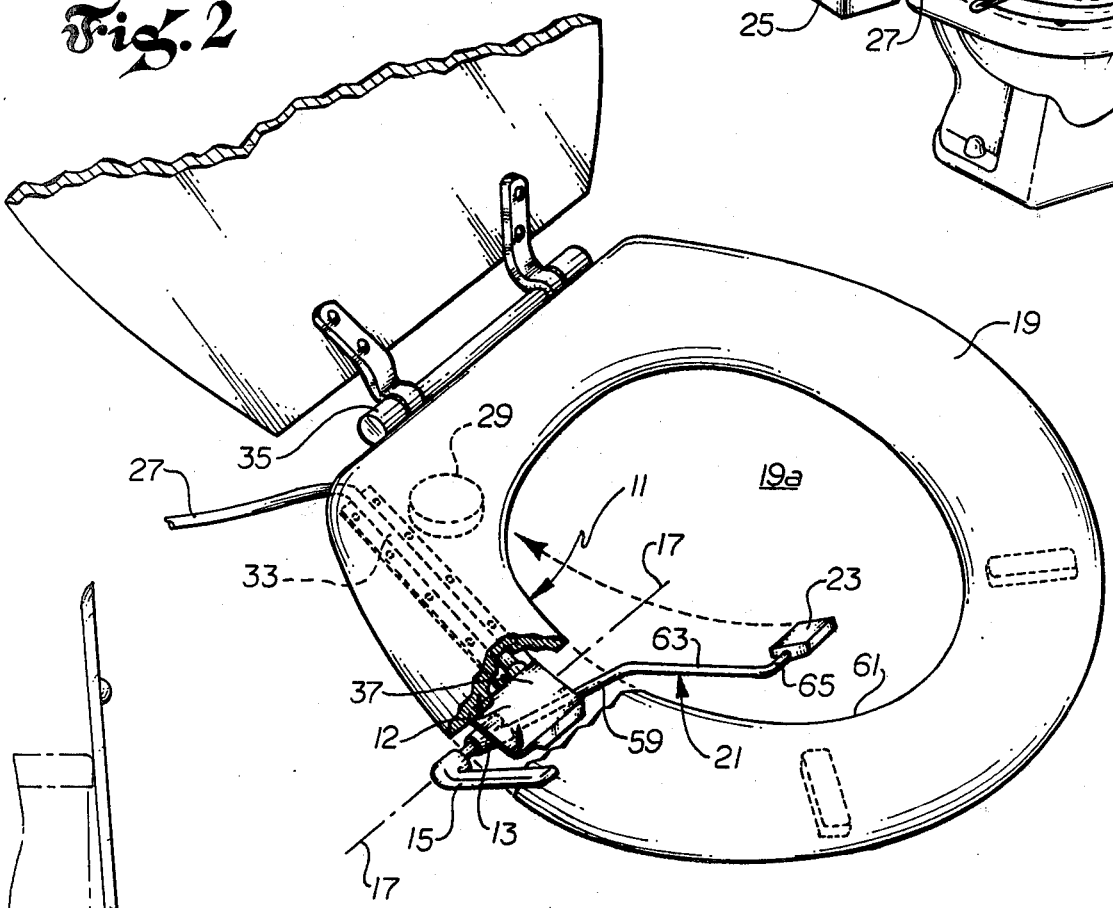
Fig. 3
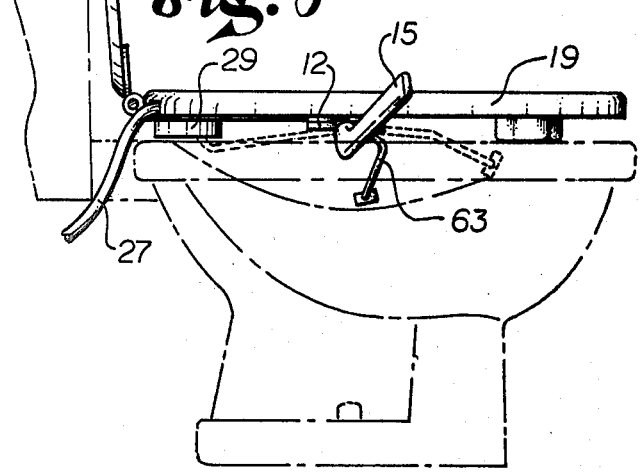
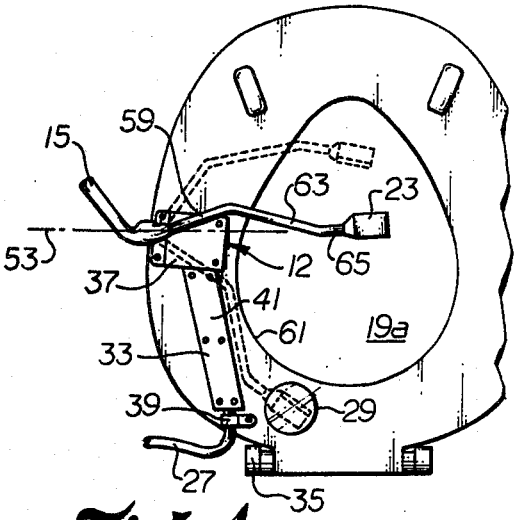
Fig. 4

HYGIENE APPARATUS FOR TOILETS

BACKGROUND OF THE INVENTION

This invention relates generally to the art of toilets or water closets, and more particularly concerns a hygiene apparatus which is adapted for attachment to a toilet seat or bowl.

The invention is to be used for personal hygiene, particularly for cleansing of the rectal and genital areas of the body. It can be used, for instance, immediately following use of the toilet, without further undressing.

Private hygiene bathroom fixtures, referred to as bidets, are well known and rather extensively used in certain parts of the world, although they are generally regarded as being primarily for feminine personal hygiene. Although the advantages of the bidet are becoming increasingly well recognized in the United States, it is highly impractical to install a bidet in existing bathroom facilities, particularly in private residences, because of the space required and the need for an additional drain.

Attachments for conventional toilets are known which attempt to provide the cleansing capability of a bidet. Such devices theoretically would overcome the problems of space and drain capability noted above. At least one such device is presently on the market.

However, these devices, because they must operate in the physical context of a conventional toilet, have been found to have several practical disadvantages. A severe disadvantage is the poor cleansing effect of such devices due to poor or uneven coverage of the target area, i.e. the rectal and genital areas of the body. Another disadvantage of such devices is that they frequently splash water onto the floor or the clothes of the user. These two disadvantages are due primarily to the design parameters imposed on such devices, i.e. that they fit within a conventional toilet and that they be out of the way and preferably out of sight when not in use.

A third disadvantage with such devices is their lack of effective warm-up capability. Most devices have used a pivoting sprayhead which may be moved so that the water can be directed down into the bowl until it is sufficiently warm to be used. Such an arrangement, however, complicates the mechanical aspects of the device and adds to the expense.

Accordingly, it is an object of the present invention to provide a hygiene apparatus for toilets which overcomes one or more of the disadvantages of the prior art specified above.

It is another object of the present invention to provide such an apparatus which is adapted for attachment to a conventional toilet.

It is a further object of the present invention to provide such an apparatus which may be moved to a retracted position when not in use, where it is substantially out of sight.

It is an additional object of the present invention to provide such an apparatus which provides good cleansing of the entire target area.

It is yet another object of the present invention to provide such an apparatus which does not splash the cleansing fluid, e.g. water, either on the floor or on the clothes of the user.

It is a still further object of the present invention to provide such an apparatus which permits convenient discharge of fluid into the toilet bowl.

It is yet another object of the present invention to provide such an apparatus which is mechanically simple and easy to clean.

SUMMARY OF THE INVENTION

Accordingly, the present invention is a hygiene apparatus adapted for use with a conventional toilet, which includes a toilet bowl and a toilet seat. The apparatus includes a support means which is positioned in the general area of the rim of the toilet bowl. The support means includes a handle and is movable between first and second positions. Means are provided for supplying a washing fluid, such as water, to the support means. Elongated fluid carrying arm means and a sprayhead means complete the apparatus. The arm means is connected at one end to the support means and is in fluid connection therewith, and at the other end is positioned the sprayhead means. The arm means is connected to the support means at such an orientation and further is so configured, that when said support means is moved between said first and second positions, (1) a first portion of said arm means moves between the toilet bowl and the toilet seat and (2) said sprayhead means moves in a relatively shallow arc beneath the opening of the toilet seat, with the focus of the arc being a point at least several inches above the plane of the toilet seat.

DESCRIPTION OF THE DRAWINGS

A more thorough understanding of the invention may be obtained by a study of the following detailed description taken in connection with the accompanying drawings in which:

FIG. 1 is an environmental view of the apparatus of the present invention.

FIG. 2 is an isometric view of the apparatus of FIG. 1.

FIG. 3 is a side elevational view of the apparatus of FIG. 1.

FIG. 4 is a bottom plan view of the apparatus of FIG. 1.

DESCRIPTION OF THE PREFERRED EMBODIMENT

Figure 5:
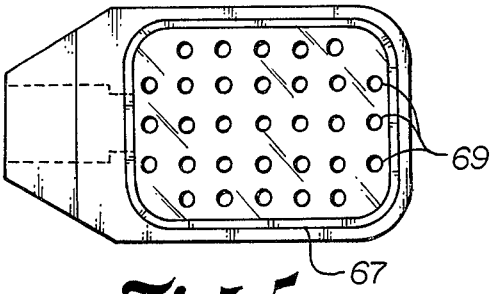
FIG. 5 is a top plan view of the sprayhead portion of the apparatus of FIG. 1.

Referring now to FIGS. 1–4, and 7–8, the present invention is shown in an environment of a conventional toilet. Briefly, the apparatus, which is shown generally at 11, includes a base 12, and a support element 13, a part of which is shaped into an elongated bar-like handle 15. The support element 13 is rotatable about an axis 17, which is at a prescribed angle relative to the plane of the toilet seat 19 to which the apparatus 11 is attached.

An elongated fluid-carrying arm 21 extends outward from support element 13, and terminates in a sprayhead 23. Water is supplied to the apparatus through a hot and cold water mixer 25 and a tube 27, which connects the mixer 25 with the support 13 through base 12. A portion of support element 13 is hollow, so that there is a direct fluid connection between mixer 25 and the sprayhead 23.

The axis of rotation 17 is at such an angle relative to the plane of the toilet seat and the elongated arm 21 is so configured that the sprayhead 23 moves in a relatively shallow arc from a retracted position, in which it is nestled adjacent deflector 29, which is secured to the underside of the toilet seat 19 towards the rear thereof, through an operative path beneath the opening 19*a* in the toilet seat.

Along its operative path, the sprayhead 23 moves from the rear of the seat to the front. The sprayhead is approximately 3 inches below the plane of the lower surface of the toilet seat, when it is in approximately the middle of the opening 19*a*. The focal point of the arc of the sprayhead is several inches above the toilet seat, so that thorough coverage of the target area over the plane of the opening 19*a* results as the sprayhead moves through its path of travel. Such an arrangement, which will be described in more detail hereinafter, solves many of the problems of the prior art noted above.

Referring now to FIGS. 1–4 and 7–8 in detail concerning the operation of the apparatus, a washing fluid, usually water, is supplied to the apparatus from available hot/cold water plumbing lines (not shown). This water is delivered to the mixer 25, in which the hot and cold water is mixed in a prescribed ratio, which is set by the user through mixer handle 31. The mixer is supported on a platform-like plate which is connected to the toilet bowl through the toilet seat connections.

The output of mixer 25 is channeled through a tube 27, which for appearance and protection purposes can be covered by a metal flex hose (not shown), to the main part of the apparatus. The covered tube extends to the outer edge of the lower surface of the seat 19, where it enters an elongated channel 33 in the lower surface of the seat. The chanel 33 is deep enough to accommodate the covered tube, and extends from a point immediately adjacent one of the pivot points 35 of the seat 19 to approximately the longitudinal midpoint 37 of the seat along one side thereof. A keeper 39 maintains the tube 27 and the flexhose in position where it enters the channel 33. A cover plate 41 covers the channel and the tube therein along the length of the channel 33.

The elongated channel 33 terminates in a cavity in which is positioned base 12. Base 12 in the embodiment shown is about 2 inches square by approximately ½ inch deep. Base 12 extends downwardly from the lower surface of the seat approximately ¼ inch. Three sides of base 12 are defined by flat walls 45, while the top of base 12 comprises plate 47, the major part of which is parallel with the plane of the lower surface of the toilet seat, i.e. it is horizontal when the seat is down. The other part of plate 47 is angled portion 49, which comprises the remaining wall of base 12. Angled portion 49 extends at an angle of approximately 45° relative to the plane of the lower surface of the toilet seat, and is substantially parallel with the longitudinal dimension of the seat. The angle of portion 49 determines the angle of the axis of rotation 17. It can vary somewhat, i.e. ±10°, without detriment to the operation of the apparatus.

Extending from the angled portion 49 of plate 47 is support element 13, which is rotatably connected thereto. One end of support element 13 extends slightly into the interior of the base 12, where it rotatably mates with the end of tube 27. The support element 13 has a hollow portion which extends to the connection with tube 27, so that there is a fluid connection between the tube and support element 13.

Support element 13 is somewhat irregular in configuration, having one portion which extends through an opening in angled portion 49 of base 12 to rotatably receive the end of tube 27, as well as other portions, from which handle 15 and elongated arm 21 extend. Support element 13 is rotatably secured or supported on angled portion 49 such that it rotates about an axis 17 which is substantially perpendicular to the plane of angled portion 49, which intersects the lower surface of the toilet seat at an angle of about 45°. Thus, axis 17 is at an angle of approximately 45° from the plane of the lower surface of the seat as well. Axis 17 also is generally in a lateral plane of the seat.

The handle 15 extends from portion 54 of support 13, and is an elongated flat element which in the embodiment shown is approximately 3 inches long, by ¾ inch wide, by ⅜ inch thick. It is beveled and rounded at its exposed edges and corners to facilitate a comfortable fit with the hand of the user.

The elongated fluid carrying arm 21 is hollow, and is connected at one end 57 to portion 55 of support 13, which in turn is connected with the hollow region of support 13 so that there is a fluid connection from tube 27 through support 13 to the elongated arm 21.

The elongated arm 21 has a particular configuration which assists in achieving the objects of the present invention. It comprises, in the embodiment shown, three sections, each of which is substantially straight, combined into a complex shape. Although the arm 21 is secured to support element 13 at portion 55, its theoretical pivot point is the point where it would intersect axis 17, if continued to the axis.

The configuration and relative position of each portion of arm 21 will be described when the arm is in its retracted position. A first portion 59 of the arm extends outwardly from support 13 in approximately the same plane as the lower surface of the seat 19. It extends somwhat toward the rear of the seat, approximately 15°–20° from the lateral axis and just about to the boundary edge 61 of opening 19*a*. As the sprayhead 23 is moved through its operative path, portion 59 moves through a very shallow arc, substantially parallel to the plane of seat 19, in the space between the seat and the top of the bowl. The portion 59 is so configured generally and is connected to support element 13 at such an angle that its entire range of movement is between the seat and the bowl. Portion 59 is thus generally hidden from view beneath seat 19.

A second portion 63 of arm 21 extends from the first portion and is approximately 3½ inches long in the embodiment shown. It is angled downwardly at approximately 30° from the plane of the seat 19 and rearwardly at approximately 45° when the first portion is parallel with the lateral axis of the seat. This portion of the arm 21, which extends approximately from the seat edge 61 into the opening 19*a*, is thus secured to the first portion 59 at such an angle to provide the desired arcuate path of the sprayhead 23. When the apparatus is in its fully retracted position, the second portion 63 is hidden underneath the seat but is relatively close to the edge 61 of the opening 19*a*. As the sprayhead moves through its operative path, portion 63 moves below the opening 19*a*, with the far end of portion 63, e.g. the end nearest sprayhead 23, describing a shallow arc beneath the opening 19*a*.

The third portion 65 of arm 21 is relatively short, approximately 1 inch in the embodiment shown, and terminates at the sprayhead 23. The third portion 65 is oriented relative to the second portion such that it extends in the same direction as the first portion, and such that the sprayhead 23 is nestled in deflector 29 when the sprayhead is in its retracted position.

The sprayhead 23 in the embodiment shown (FIG. 5) is rectangular, approximately 1½ inches long, by ¾ inch wide, by ½ inch deep. In one surface thereof is located a plurality of small holes 69 through which is forced the fluid from mixer 25 in the form of a spray.

The relationship of arm 21 to sprayhead 23 and the handle 15 are such that when handle 15 is in a substantially horizontal position adjacent the outer edge of seat 19, sprayhead 23 is near the lower surface of the seat, just to one side of the very rear thereof, nestled in deflector 29. In this position, sprayhead 23 is at a slight angle to the plane of the lower surface of the seat.

Figure 6:
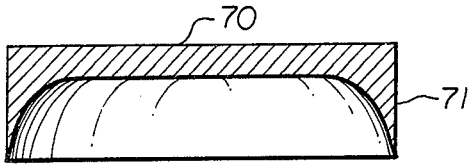
FIG. 6 is a cross-section view of the deflector portion of the apparatus of FIG. 1.
Figure 7:
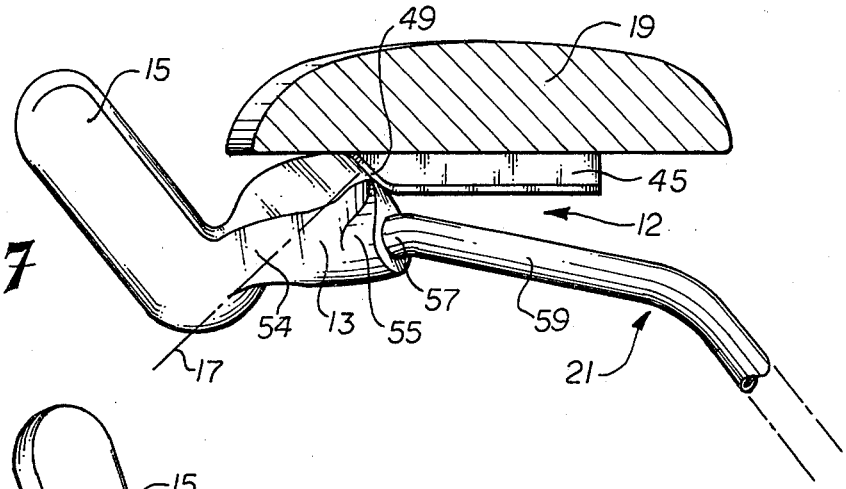
FIG. 7 is an elevational, partially cross-sectional, view showing in detail the relationship between the handle, the support base and a portion of the fluid carrying arm means of the present invention.
Figure 8:
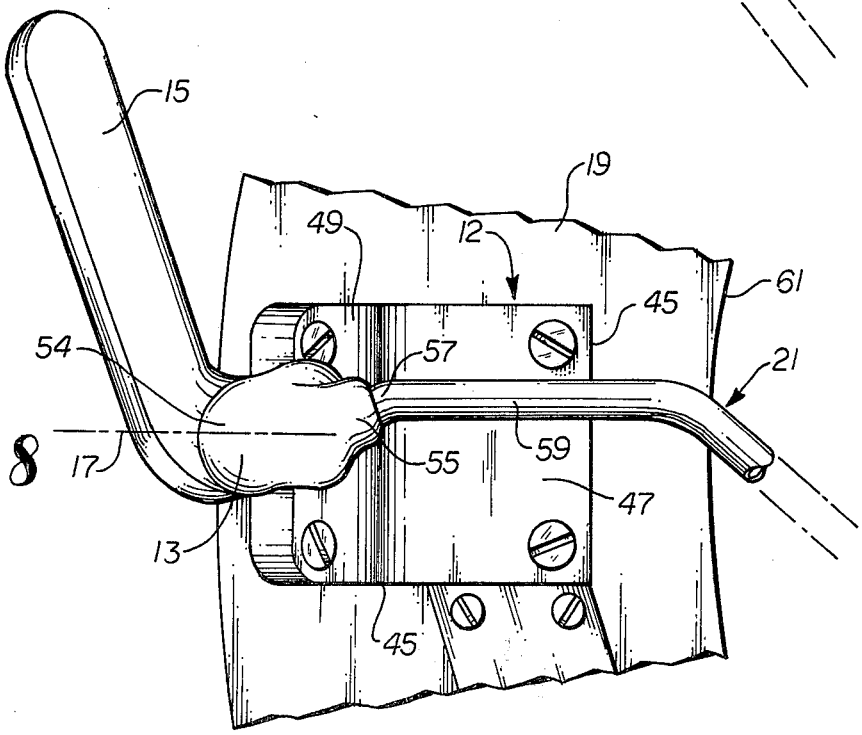
FIG. 8 is a bottom plan view of the combination shown in FIG. 7.

The deflector of the present invention in the embodiment shown is cup-like in configuration, approximately 2 inches in diameter and ½ inch high. It includes a base 70 (FIG. 6) which is secured to the lower surface of the seat 19, and a relatively thin boundary wall 71 which is flat on its exterior surface, but curved on its interior surface, so that there are no angles or sharp corners in the interior of deflector 29.

The deflector 29 is positioned so that it is slightly offset from the rearmost central portion of the seat. When the head 23 is in its fully retracted position, it extends partly into the cavity defined by the deflector. When fluid enters the apparatus when sprayhead 23 is in its retracted position, the fluid is deflected down into the toilet bowl. This is particularly advantageous, as the cooler water present in the apparatus upon initiation of its operation may be conveniently directed into the bowl without any splashing. In another embodiment, a heater may be provided in the mixer 25 to insure even water temperature for the apparatus.

After the water is at the desired temperature, the handle 15 is rotated by the user so that sprayhead 23 is in the desired position relative to the user. Due to the physical arrangement of the various parts of the apparatus, sprayhead 23 moves through an arc which extends from the rear of the opening 19*a*, where it is approximately 1½ inches below the plane of the lower surface of the toilet seat, to the front of the opening, where again it is about 1½ inches below the plane of the seat. At the midpoint of its arc, the sprayhead is approximately 3 to 2½ inches below the seat plane.

With such an arrangement, sprayhead 23 does not come in contact with the user but still clears the water in the bowl. The fluid in the apparatus is under sufficient pressure to create a spray which is directed toward the focal point of the arc, which is usually some distance, i.e. 3–4 inches, above the plane of the toilet seat. As sprayhead 23 moves through its arc, the spray will be always directed to that focal point. The target area for the spray, however, will generally be on a plane which is between the focal point of the arc and sprayhead 23. A relatively wide coverage area is thus possible for the target area over the path of sprayhead 23.

Hence, a hygiene apparatus useful as an attachment for conventional toilets has been described. The apparatus is convenient and efficient, yet is unobtrusive when in its fully retracted position. The spray from the apparatus provides a relatively wide coverage of the target area, but does not result in splashing of the clothes of the user. It furthermore includes means to insure that the fluid provided for cleansing is at the desired temperature, and is arranged so that no part of the apparatus will come in contact with either the user or the water in the bowl.

Although an exemplary embodiment of the invention has been disclosed herein for purposes of illustration, it should be understood that various changes, modifications and substitutions may be incorporated in such embodiment without departing from the spirit of the invention as defined by the claims which follow.

What is claimed is:

1. A hygiene apparatus adapted for use with a conventional toilet which includes a toilet bowl and a toilet seat, comprising:

support means, which includes handle means positioned in the general area of the rim of the toilet bowl, and movable between first and second positions;

means supplying a washing fluid, such as water, to said support means;

elongated fluid carrying arm means connected at one end thereof to said support means and in fluid connection therewith; and sprayhead means secured to the other end of said arm means, base means mounted on the underside of said seat and having an angled portion extending approximately in the range of 45°, ±10° relative to the plane of the seat and parallel to the lateral axis thereof, wherein said support means is rotatably mounted on said angled portion of said base means and is rotatable about a support axis which is at an angle of approximately in the range of 45°, ±10° relative to the horizontal plane of the toilet seat, and wherein said sprayhead means is positioned a sufficient distance from said axis of rotation by said fluid carrying carrying arm means that the sprayhead means follows a line path between a first position beneath the rear of the toilet seat and a second position which is substantially intermediate of the opening of the toilet seat near the front end thereof, and such that said sprayhead means moves in a relatively shallow arc beneath the opening of the toilet seat, clearing the fluid in the toilet bowl and the user seated on the toilet seat, with the focus of the arc being a point at least several inches above the plane of the toilet seat.

2. An apparatus of claim 1 wherein said base means is positioned approximately midway between the front and the rear of the toilet seat.

3. An apparatus of claim 2, including means for receiving the fluid from an external source thereof, wherein said toilet seat includes a channel therein which begins near the rear thereof and terminates at said base means and wherein a portion of said receiving means is positioned in said channel.

4. An apparatus of claim 1, wherein said fluid-carrying arm means and said sprayhead means are not in view when said support means is in said first position.

5. An apparatus of claim 4, including deflector means positioned on the lower surface of said seat near the rear thereof, said deflector means being cup-like in general configuration, including a base surface and a surrounding wall which is curved into the base surface, said sprayhead substantially nestling in said deflector means when said sprayhead is in a retracted position such that fluid from the sprayhead in its retracted position is reflected by said deflector means down into the toilet bowl.

6. An apparatus of claim 1, wherein, when said sprayhead means is at its lowermost position, substantially opposite said support means, the first portion of said fluid carrying arm means, which extends from said support means to approximately the inner edge of the toilet seat, is at a relatively small angle relative to the horizontal plane of the toilet seat, while the remainder of said fluid carrying arm means, which extends into the toilet bowl, is at a substantial angle relative to the horizontal plane of the toilet seat.

7. An apparatus of claim 1, wherein said sprayhead means is positioned at such an angle relative to the fluid carrying arm means on which it is mounted that the path of the spray from the sprayhead means follows substantially the longitudinal axis of the toilet seat as said sprayhead means moves between its first and second positions.

* * * * *

UNITED STATES PATENT AND TRADEMARK OFFICE

CERTIFICATE OF CORRECTION

PATENT NO. : 4,197,594

DATED : April 15, 1980

INVENTOR(S) : Peter Butterfield

It is certified that error appears in the above-identified patent and that said Letters Patent are hereby corrected as shown below:

Claim 1, line 14, after the first use of the word "means", substitute a semicolon for the comma and begin a new paragraph with the words "base means mounted...".

Claim 1, line 26, delete the word "carrying".

Signed and Sealed this

*Eighteenth* Day of *November 1980*

[SEAL]

*Attest:*

SIDNEY A. DIAMOND

*Attesting Officer*

*Commissioner of Patents and Trademarks*